US008918016B2

(12) United States Patent
Okamoto et al.

(10) Patent No.: US 8,918,016 B2
(45) Date of Patent: Dec. 23, 2014

(54) PROCESS CARTRIDGE AND IMAGE FORMING APPARATUS INCLUDING SAME

(71) Applicants: Michiya Okamoto, Kanagawa (JP); Ken Amemiya, Tokyo (JP); Takuma Iwasaki, Kanagawa (JP); Shinya Karasawa, Kanagawa (JP); Hiroyuki Uenishi, Kanagawa (JP); Hideki Kimura, Kanagawa (JP)

(72) Inventors: Michiya Okamoto, Kanagawa (JP); Ken Amemiya, Tokyo (JP); Takuma Iwasaki, Kanagawa (JP); Shinya Karasawa, Kanagawa (JP); Hiroyuki Uenishi, Kanagawa (JP); Hideki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 113 days.

(21) Appl. No.: 13/779,850

(22) Filed: Feb. 28, 2013

(65) Prior Publication Data

US 2013/0243478 A1 Sep. 19, 2013

(30) Foreign Application Priority Data

Mar. 13, 2012 (JP) ..... 2012-055762

(51) Int. Cl.
*G03G 21/18* (2006.01)

(52) U.S. Cl.
USPC ..... 399/113

(58) Field of Classification Search
CPC ..... G03G 21/181; G03G 21/1817; G03G 21/1821; G03G 2221/1853; G03G 2221/1869
USPC ..... 399/109, 111, 113
See application file for complete search history.

(56) References Cited

U.S. PATENT DOCUMENTS

| | | | | |
|---|---|---|---|---|
| 7,209,680 | B2 * | 4/2007 | Kweon | 399/111 |
| 7,805,093 | B2 * | 9/2010 | Yoshino | 399/111 |
| 8,238,784 | B2 * | 8/2012 | Kusudo et al. | 399/109 |
| 8,457,522 | B2 * | 6/2013 | Watanabe | 399/111 |
| 8,559,847 | B2 * | 10/2013 | Murakawa | 399/113 |
| 8,639,160 | B2 * | 1/2014 | Chadani et al. | 399/113 |
| 2010/0034557 | A1 | 2/2010 | Arai et al. | |
| 2012/0107012 | A1 | 5/2012 | Amemiya et al. | |
| 2012/0195661 | A1 | 8/2012 | Karasawa et al. | |

FOREIGN PATENT DOCUMENTS

| | | | |
|---|---|---|---|
| JP | 10293516 A | * | 11/1998 |
| JP | 2010-061102 | | 3/2010 |

* cited by examiner

*Primary Examiner* — Robert Beatty
(74) *Attorney, Agent, or Firm* — Harness, Dickey & Pierce, P.L.C.

(57) ABSTRACT

A process cartridge detachably installable in an image forming apparatus including a first sub-unit to hold an image carrier, a second sub-unit to hold a developer bearing member, a first positioning member to position first ends of the image carrier and the developer bearing member in a longitudinal direction, respectively, and a second positioning member to position second ends of the image carrier and the developer bearing member opposite the first ends in the longitudinal direction, respectively. The second sub-unit has a protruding portion protruding outward to a first end of the second sub-unit beyond the first positioning member in the longitudinal direction. An opposing surface of the protruding portion provided to face the first positioning member is dimensioned to conform to a cross-section of the first positioning member perpendicular to the longitudinal direction.

9 Claims, 6 Drawing Sheets

PROCESS CARTRIDGE AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2012-055762, filed on Mar. 13, 2012, in the Japan Patent Office, the entire disclosure of which is hereby incorporated by reference herein.

BACKGROUND OF THE INVENTION

1. Field of the Invention

Exemplary aspects of the present invention generally relate to a process cartridge detachably installable in an image forming apparatus, and more particularly to a process cartridge constructed of a first sub-unit that holds an image carrier and a second sub-unit that holds a developer bearing member, and an image forming apparatus including the process cartridge.

2. Description of the Related Art

Related-art image forming apparatuses, such as copiers, printers, facsimile machines, and multifunction devices having two or more of copying, printing, and facsimile capabilities, typically form a toner image on a recording medium (e.g., a sheet of paper, etc.) according to image data using, for example, an electrophotographic method. In the electrophotographic method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

The photoconductor and the developing device that holds a developer bearing member such as a developing roller are often formed together as a single integrated process cartridge detachably installable in the image forming apparatus.

In the process cartridge, a precise gap between the image carrier and the developer bearing member must be provided, without damage to the image carrier and the developer bearing member upon assembly of the process cartridge, in order to achieve high-quality images; i.e., images having a uniform image density.

There is known a process cartridge constructed of a first sub-unit that holds the image carrier and a second sub-unit that holds the developer bearing member. First and second positioning members that position the image carrier and the developer bearing member are provided at both ends of each of the image carrier and the developer bearing member in a longitudinal direction. Specifically, the first positioning member is fixed to one end of each of the first and second sub-units in the longitudinal direction with screws, and the second positioning member is fixed to the opposite end of one of the first and second sub-units in the longitudinal direction with screws.

As a result, a precise gap between the image carrier and the developer bearing member is accurately and evenly provided across the longitudinal direction without a failure of positioning of the image carrier and the developer bearing member in the longitudinal direction.

However, upon attachment of the first and second positioning members to the first and second sub-units, the image carrier, which is exposed outside the first sub-unit, and the developer bearing member, which is exposed outside the second sub-unit, may contact each other, possibly damaging the surface of the image carrier or the developer bearing member.

SUMMARY OF THE INVENTION

In view of the foregoing, illustrative embodiments of the present invention provide a novel process cartridge in which a precise gap between an image carrier and a developer bearing member is accurately and evenly provided across a longitudinal direction without damage to the surface of the image carrier or the developer bearing member upon assembly of the process cartridge. Illustrative embodiments of the present invention further provide a novel image forming apparatus including the process cartridge.

In one illustrative embodiment, a process cartridge detachably installable in an image forming apparatus includes a first sub-unit to hold an image carrier, a second sub-unit to hold a developer bearing member disposed opposite the image carrier across a predetermined gap, a first positioning member to position first ends of the image carrier and the developer bearing member in a longitudinal direction, respectively, and a second positioning member to position second ends of the image carrier and the developer bearing member opposite the first ends in the longitudinal direction, respectively. The first positioning member is fixed to a first end of the first sub-unit in the longitudinal direction while positioning the first end of the image carrier before assembly of the first and second sub-units. The second positioning member is fixed to a second end of the second sub-unit in the longitudinal direction while positioning the second end of the developer bearing member before the assembly of the first and second sub-units. The second sub-unit has a protruding portion protruding outward to a first end of the second sub-unit opposite the second end beyond the first positioning member in the longitudinal direction. An opposing surface of the protruding portion provided to face the first positioning member is dimensioned to conform to a cross-section of the first positioning member perpendicular to the longitudinal direction.

In another illustrative embodiment, an image forming apparatus includes at least one process cartridge described above.

Additional features and advantages of the present disclosure will become more fully apparent from the following detailed description of illustrative embodiments, the accompanying drawings, and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 6(*b*) is a perspective view of the developing unit to which a rear plate is fixed;

DETAILED DESCRIPTION OF THE INVENTION

Figure 1:
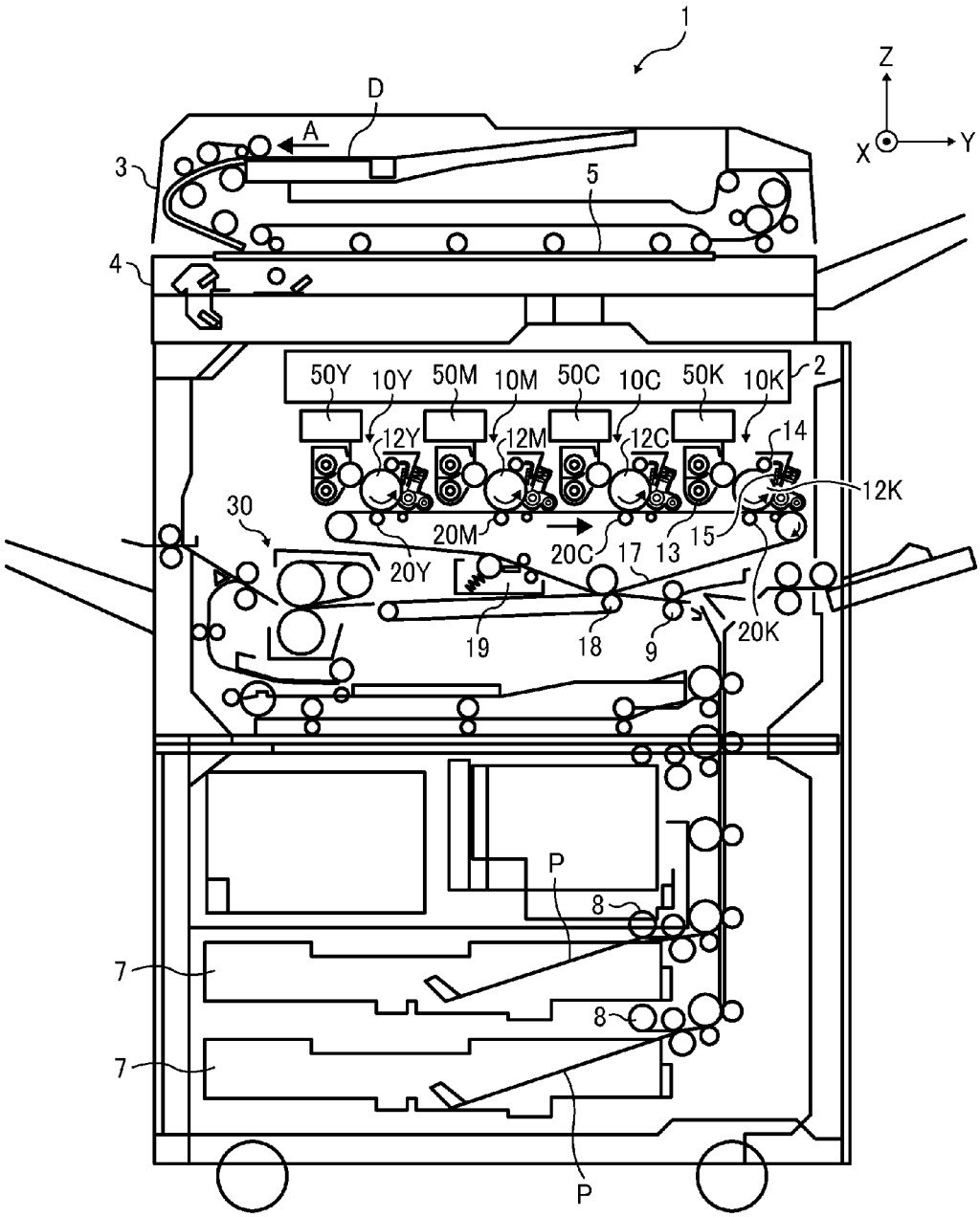
FIG. 1 is a vertical cross-sectional view illustrating an example of a configuration of an image forming apparatus according to an illustrative embodiment.

It is to be noted that, in the present specification, a process cartridge is defined as a single integrated unit in which an image carrier and at least one of a charger that charges the image carrier, a developing device that develops a latent image formed on the image carrier, and a cleaning device that cleans the image carrier are formed together to be detachably installable in an image forming apparatus.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration and operation of an image forming apparatus 1 according to an illustrative embodiment. In the present illustrative embodiment, the image forming apparatus 1 is a tandem-type full-color copier.

FIG. 1 is a vertical cross-sectional view illustrating an example of a configuration of the image forming apparatus 1 according to the illustrative embodiment. The image forming apparatus 1 includes a writing unit 2 from which laser light is emitted based on input image data, a document reading unit 4 that reads image data on a document D, a document conveyance unit 3 that conveys the document D to the document reading unit 4, sheet feeders 7 that respectively accommodate a recording medium P such as a transfer sheet, a pair of registration rollers 9 that adjusts a timing to convey the recording medium P, and process cartridges 10Y, 10M, 10C, and 10K (hereinafter collectively referred to as process cartridges 10), each of which forms a toner image of a specific color, that is, yellow (Y), magenta (M), cyan (C), or black (K).

The image forming apparatus 1 further includes an intermediate transfer belt 17 onto which the toner images of the specified colors are transferred one atop the other to form a single full-color toner image, a secondary transfer bias roller 18 that secondarily transfers the full-color toner image formed on the intermediate transfer belt 17 onto the recording medium P, a belt cleaning unit 19 that cleans the intermediate transfer belt 17, primary transfer bias rollers 20Y, 20M, 20C, and 20K (hereinafter collectively referred to as primary transfer bias rollers 20), each of which primarily transfers the toner image formed on a photoconductor 12Y, 12M, 12C, or 12K (hereinafter collectively referred to as photoconductors 12) onto the intermediate transfer belt 17, a fixing device 30 that fixes an unfixed toner image onto the recording medium P, and toner cartridges 50Y, 50M, 50C, and 50K (hereinafter collectively referred to as toner cartridges 50) that respectively store toner of the specified colors.

Figure 2:
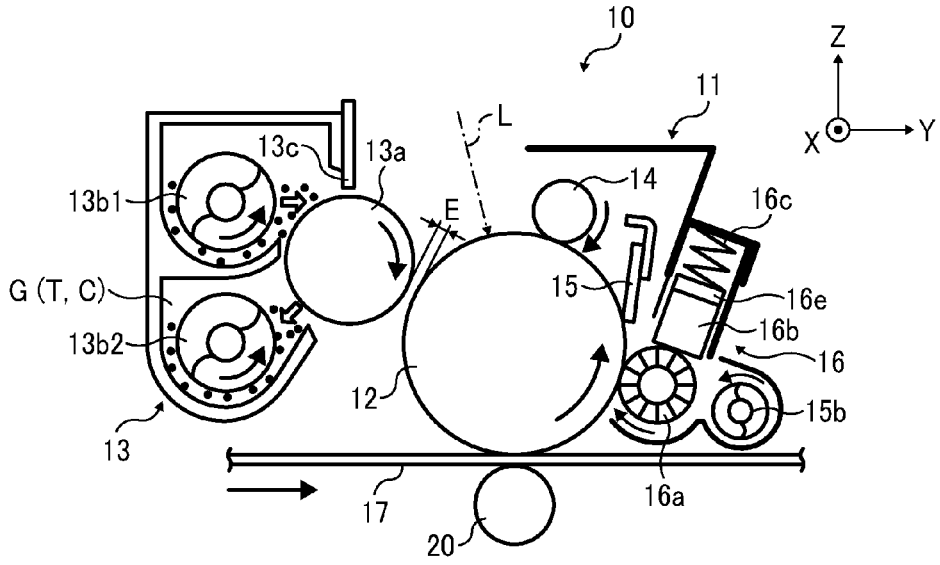
FIG. 2 is a vertical cross-sectional view illustrating an example of a configuration of a process cartridge included in the image forming apparatus illustrated in FIG. 1.

A description is now given of full-color image formation performed by the image forming apparatus 1, with reference also to FIG. 2. FIG. 2 is a vertical cross-sectional view illustrating an example of a configuration of the process cartridge 10. It is to be noted that, each of the process cartridges 10 has the same basic configuration, differing only the color of toner used. Therefore, suffixes Y, M, C, and K, each representing the color of toner, are hereinafter omitted.

The document D set on a document stand, not shown, is conveyed by conveyance rollers provided to the document conveyance unit 3 in a direction indicated by an arrow A in FIG. 1 to be placed on a contact glass 5 provided to the document reading unit 4. The document reading unit 4 optically reads image data of the document D thus conveyed onto the contact glass 5.

Specifically, the document reading unit 4 scans an image on the document D with light emitted from a lamp. Light reflected from the document D is focused on a color sensor via a group of mirrors and lenses. The color sensor reads color image data of the document D separately for color separation components red (R), green (G), and blue (B), and the color image data for each color separation component thus read is converted into electrical signals. In addition, an image processing unit, not shown, performs color conversion, color correction, spatial frequency correction, and so forth on the image data based on the image signals of R, G, and B to obtain color image data of yellow (Y), magenta (M), cyan (C), and black (K).

The image data of yellow (Y), magenta (M), cyan (C), and black (K) is then sent to the writing unit 2. The writing unit 2 directs laser light L onto the photoconductors 12 provided to the respective process cartridges 10 based on the image data of the respective colors.

Meanwhile, the photoconductors 12 are rotated in a counterclockwise direction in FIG. 1, respectively, and a surface of each photoconductor 12 is evenly charged by a charging roller 14. Accordingly, a charging electrical potential is formed on the surface of each photoconductor 12. As the photoconductor 12 rotates, the charged surface of the photoconductor 12 reaches a position onto which the laser light L of the specified color is directed from the writing unit 2.

At this time, the laser light L each corresponding to the image signal of the specified color is emitted from the corresponding light source of the writing unit 2. The laser light L thus emitted follows optical paths for each color component of yellow (Y), magenta (M), cyan (C), or black (K), respectively.

Specifically, the laser light L corresponding to the color component of yellow (Y) is directed onto the surface of the photoconductor 12Y. At this time, the laser light L corresponding to the color component of yellow (Y) scans in a direction of a rotary shaft of the photoconductor 12Y, that is, a main scanning direction, using a polygon minor rotated at high speed. Accordingly, an electrostatic latent image of yellow (Y) is formed on the charged surface of the photoconductor 12Y.

Similarly, the laser light L corresponding to the color component of magenta (M) is directed onto the surface of the photoconductor 12M, so that an electrostatic latent image of magenta (M) is formed on the charged surface of the photoconductor 12M. The laser light L corresponding to the color component of cyan (C) is directed onto the surface of the photoconductor 12C, so that an electrostatic latent image of cyan (C) is formed on the charged surface of the photoconductor 12C. The laser light L corresponding to the color component of black (K) is directed onto the surface of the photoconductor 12K, so that an electrostatic latent image of black (K) is formed on the charged surface of the photoconductor 12K.

As the photoconductor 12 further rotates, the electrostatic latent image thus formed on the surface of each photoconductor 12 reaches a developing part, which in the present illustrative embodiment, is a developing unit 13. The developing unit 13 supplies toner of the specified color to the surface of the corresponding photoconductor 12 to develop the electrostatic latent image formed on the photoconductor 12 with the toner. Accordingly, toner images of the specified colors are formed on the surfaces of the photoconductors 12, respectively.

The toner images thus formed on the surfaces of the photoconductors 12 are then conveyed to primary transfer positions where the photoconductors 12 face the intermediate transfer belt 17, respectively. At the primary transfer positions, the primary transfer bias rollers 20 are provided to contact an inner circumferential surface of the intermediate transfer belt 17, respectively. The primary transfer bias rollers 20 primarily transfer the toner images from the surfaces of the photoconductors 12 onto the intermediate transfer belt 17. As a result, the toner images are sequentially superimposed one atop the other to form a single full-color toner image on the intermediate transfer belt 17.

The surface of each photoconductor 12, from which the toner image is primarily transferred onto the intermediate transfer belt 17, then reaches a cleaning blade 15 as the photoconductor 12 further rotates. The cleaning blade 15 removes extraneous substances such as untransferred toner remaining attached to the photoconductor 12 without being transferred onto the intermediate transfer belt 17 from the surface of the photoconductor 12.

Thereafter, the surface of the photoconductor 12 is neutralized by a neutralizing device, not shown, to complete one image formation sequence performed on the photoconductor 12.

Meanwhile, the intermediate transfer belt 17 bearing the full-color toner image thereon is rotated in a clockwise direction in FIG. 1 so that the full-color toner image reaches the secondary transfer bias roller 18. The secondary transfer bias roller 18 secondarily transfers the full-color toner image from the intermediate transfer belt 17 onto the recording medium P.

Thereafter, a portion of the intermediate transfer belt 17, from which the full-color toner image is secondarily transferred onto the recording medium P, reaches the belt cleaning unit 19. The belt cleaning unit 19 collects untransferred toner remaining attached to the intermediate transfer belt 17 without being transferred onto the recording medium P to complete one transfer sequence performed on the intermediate transfer belt 17.

The recording medium P is conveyed to a secondary transfer nip formed between the intermediate transfer belt 17 and the secondary transfer bias roller 18 from one of the sheet feeders 7 via the pair of registration rollers 9 and so on.

Specifically, the recording medium P accommodated in one of the sheet feeders 7 is fed and conveyed by a sheet feed roller 8 to the pair of registration rollers 9 via a conveyance guide, not shown. The recording medium P is then conveyed to the secondary transfer nip by the pair of registration rollers 9 in synchronization with the full-color toner image formed on the intermediate transfer belt 17, so that the full-color toner image is secondarily transferred onto the recording medium P by the secondary transfer bias roller 18.

The recording medium P having the full-color toner image thereon is then conveyed to the fixing device 30 by a conveyance belt. In the fixing device 30, the full-color toner image is fixed onto the recording medium P at a fixing nip formed between a fixing belt and a pressing roller.

Thereafter, the recording medium P having the fixed full-color image thereon is discharged from the image forming apparatus 1 by a discharge roller, completing the image formation sequence.

Figure 3:
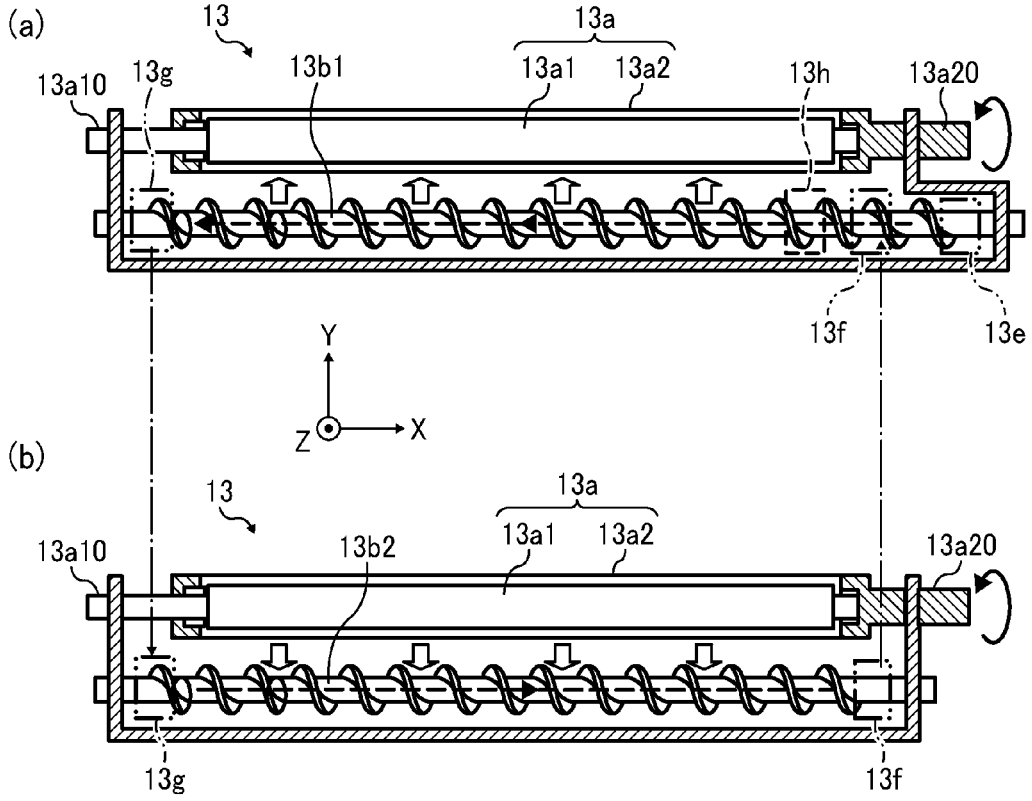
FIGS. 3(*a*) and 3(*b*) are vertical cross-sectional views respectively illustrating an example of a configuration of a developing unit included in the process cartridge illustrated in FIG. 2.

A description is now given of a configuration of the process cartridge 10 according to the illustrative embodiment with reference also to FIGS. 3(*a*) and 3(*b*). FIGS. 3(*a*) and 3(*b*) are vertical cross-sectional views respectively illustrating an example of a configuration of the developing unit 13.

Referring to FIG. 2, each process cartridge 10 is constructed of first and second sub-units, which, in the present illustrative embodiment, are a photoconductor unit 11 and the developing unit 13, respectively.

The photoconductor unit 11 is constructed of the image carrier, which, in the present illustrative embodiment, is the photoconductor 12, the charging roller 14 that charges the surface of the photoconductor 12, the cleaning blade 15 that collects untransferred toner remaining attached to the photoconductor 12, and a lubricant applicator 16 that supplies a lubricant to the photoconductor 12. As described previously, the developing unit 13 develops the electrostatic latent image formed on the photoconductor 12 with the toner.

The photoconductor unit 11 and the developing unit 13 are formed together as the single integrated process cartridge 10 detachably installable in the image forming apparatus 1.

Each photoconductor 12 is a negatively charged organic photoreceptor in which a photosensitive layer is provided on a drum-type electrically conductive support.

Specifically, an insulative undercoat layer, an electrical charge generation layer serving as the photosensitive layer, an electrical charge transport layer, and a protection layer serving as a top layer are sequentially laminated on the conductive support serving as a base layer to construct each photoconductor 12.

For example, a conductive material with a volume resistance not greater than $10^{10}$ Ωcm may be used for the conductive support of the photoconductor 12.

The charging roller 14 is a roller member including a conductive metal core coated with an elastic layer with medium resistance, and is provided downstream from the lubricant applicator 16 in a direction of rotation of the photoconductor 12 to contact the photoconductor 12.

A predetermined charging voltage is applied to the charging roller 14 by a power source, not shown, provided to the image forming apparatus 1, so that the charging roller 14 evenly charges the surface of the photoconductor 12.

Although contacting the photoconductor 12, alternatively, the charging roller 14 may be disposed apart from the photoconductor 12 with a minute gap interposed therebetween.

The cleaning blade 15 is provided downstream from the lubricant applicator 16 in the direction of rotation of the photoconductor 12. The cleaning blade 15 is formed of rubber such as urethane rubber and contacts the surface of the photoconductor 12 at a predetermined angle and pressure. Extraneous substances remaining attached to the surface of the photoconductor 12 such as untransferred toner are scraped off by the cleaning blade 15 and are collected within the process cartridge 10 as waste toner. The waste toner thus collected within the process cartridge 10 is conveyed to a waste toner container, not shown, by a conveyance screw 15*b*. It is to be noted that, in addition to the untransferred toner, examples of the extraneous substances also include paper dust from the recording medium P, corona products generated on the surface of the photoconductor 12 during electrical discharge of the charging roller 14, additives added to the toner, and other substances remaining attached to the surface of the photoconductor 12.

The cleaning blade 15 also functions as a leveling blade that levels the lubricant supplied to the surface of the photoconductor 12 by an application brush roller 16*a* provided to the lubricant applicator 16, so that the photoconductor 12 is covered with a layer of lubricant of uniform thickness.

The lubricant applicator 16 includes a solid lubricant 16*b*, the application brush roller 16*a* that slidably contacts both the photoconductor 12 and the solid lubricant 16*b*, a holder 16*e* that holds the solid lubricant 16*b*, and a compression spring 16*c* attached to the holder 16*e* that presses the holder 16*e* and the solid lubricant 16*b* against the application brush roller 16*a*.

The lubricant 16*b* is supplied to the photoconductor 12 by the lubricant applicator 16 with the above-described configuration. The lubricant thus supplied to the photoconductor 12 is leveled by the cleaning blade 15 provided downstream from the lubricant applicator 16.

The developing unit 13 includes a developer bearing member, which, in the present illustrative embodiment, is a developing roller 13*a*. The developing roller 13*a* and the photoconductor 12 are disposed opposite each other across a gap E, and a developing range (or a developing nip) is formed where a magnetic brush formed on the developing roller 13*a* contacts the photoconductor 12. The developer G, which in this case is a two-component developer including carrier C and toner T, is stored in the developing unit 13. The developing unit 13 develops the electrostatic latent image formed on the photoconductor 12 with the toner T. A configuration and operation of the developing unit 13 are described in greater detail later.

Returning to FIG. 1, each toner cartridge 50 stores the toner T to be supplied to the corresponding developing unit 13. Specifically, each toner cartridge 50 supplies the toner T to the corresponding developing unit 13 from a supply opening 13*e* via a toner supply unit, not shown, based on a toner density, which is the proportion of the toner T in the developer G, detected by a magnetic sensor 13*h* provided to the developing unit 13.

It is to be noted that, not only the toner density but also an image density detected based on a reflectivity of the toner image formed on the photoconductor 12 or the intermediate transfer belt 17, or a combination of the different sets of data may be used for determining whether to supply the toner T to the developing unit 13.

A well-known toner supply unit that supplies toner using a conveyance auger or that conveys toner together with an air flow using a screw pump may be used for supplying the toner T to the developing unit 13.

The toner cartridges 50 are detachably installable in the image forming apparatus 1 from the distal side in a direction perpendicular to the plane of FIG. 1. Accordingly, the toner cartridges 50 are replaced with new toner cartridges 50 when the toner T is used up.

A description is now given of the developing unit 13 included in the image forming apparatus 1.

Referring to FIGS. 2 and 3, the developing unit 13 includes a developer bearing member, conveyance members, and a developer restriction member, which, in the present illustrative embodiment, are the developing roller 13*a*, first and second auger screws 13*b*1 and 13*b*2, and a doctor blade 13*c*, respectively.

The developing roller 13*a* includes a sleeve 13*a*2 having a non-magnetic cylinder formed of aluminum, stainless steel, brass, conductive resin, or the like. The sleeve 13*a*2 is rotated by a rotation drive mechanism, not shown, that includes a drive gear that engages a gear provided to a sleeve shaft 13*a*20. A magnet 13*a*1 that forms multiple magnetic poles around a circumferential surface of the sleeve 13*a*2 is fixed within the sleeve 13*a*2 of the developing roller 13*a*. Specifically, a magnet shaft 13*a*10 of the magnet 13*a*1 is fitted into a front plate 41 described later. The developer G borne by the developing roller 13*a* reaches the doctor blade 13*c* as the developing roller 13*a* rotates. The doctor blade 13*a* adjusts an amount of the developer G borne by the developing roller 13*a*, so that the developer G is further conveyed to the developing range positioned opposite the corresponding photoconductor 12. The toner T is then attracted to the electrostatic latent image formed on the photoconductor 12 by a developing electric field formed at the developing range.

The doctor blade 13*c* includes a non-magnetic metal plate disposed above the developing roller 13*a*. The developing roller 13*a* is rotated in a clockwise direction in FIG. 2 while the photoconductor 12 is rotated in a counterclockwise direction in FIG. 2.

The first and second auger screws 13*b*1 and 13*b*2 agitate the developer G stored within the developing unit 13 while circulating the developer G in a longitudinal direction of the developing unit 13 perpendicular to the plane of FIG. 2.

The first auger screw 13*b*1 disposed opposite the developing roller 13*a* conveys the developer G horizontally in a direction of a rotary shaft thereof, that is, the longitudinal direction as indicated by a broken arrow in FIG. 3(*a*), and supplies the developer G onto the developing roller 13*a* at the magnetic poles as indicated by hollow arrows in FIG. 3(*a*).

The second auger screw 13*b*2 is disposed opposite the developing roller 13*a* and below the first auger screw 13*b*1. The second auger screw 13*b*2 conveys the developer G, which is separated from the developing roller 13*a* as indicated by hollow arrows in FIG. 3(*b*) after the developing process, horizontally in the longitudinal direction as indicated by a broken arrow in FIG. 3(*b*).

The second auger screw 13*b*2 returns the developer G circulated via a first transit part 13*g* from a downstream portion of a first conveyance route for the first auger screw 13*b*1 in a direction of circulation of the developer G to an upstream portion of the first conveyance route via a second transit part 13*f*.

Rotary shafts of the first and second auger screws 13*b*1 and 13*b*2 are provided substantially in a horizontal direction in a manner similar to the rotary shaft of the developing roller 13*a* or the photoconductor 12. Each of the first and second auger screws 13b1 and 13b2 is constructed of the rotary shaft and a screw spirally provided around the rotary shaft.

It is to be noted that the first conveyance route for the first auger screw 13b1 and a second conveyance route for the second auger screw 13b2 are separated from each other by a wall.

Referring to FIGS. 3(a) and 3(b), a downstream portion of the second conveyance route for the second auger screw 13b2 in the direction of circulation of the developer G communicates with the upstream portion of the first conveyance route for the first auger screw 13b1 via the second transit part 13f. The developer G that reaches the downstream portion of the second conveyance route is accumulated at the second transit part 13f and thus conveyed back to the upstream portion of the first conveyance route via the second transit part 13f.

The downstream portion of the first conveyance route for the first auger screw 13b1 communicates with an upstream portion of the second conveyance route for the second auger screw 13b2 via the first transit part 13g. The developer G which is not supplied to the developing roller 13a within the first conveyance route and thus reaches the first transit part 13g falls down by gravity through the first transit part 13g to further reach the upstream portion of the second conveyance route.

Optionally, a paddle or a screw may be provided to the second transit part 13f in order to improve the conveyance of the developer G from the downstream portion of the second conveyance route to the upstream portion of the first conveyance route through the second transit part 13f against gravity.

The above-described configuration allows formation of the first and second conveyance routes, through which the developer G is circulated within the developing unit 13 in the longitudinal direction by the first and second auger screws 13b1 and 13b2. During operation of the developing unit 13, the developer G stored within the developing unit 13 flows in the direction indicated by the broken arrows in FIGS. 3(a) and 3(b), respectively. Separation of a supply route for supplying the developer G to the developing roller 13a, that is, the first conveyance route for the first auger screw 13b1, from a collection route for collecting the developer G separated from the developing roller 13a, that is, the second conveyance route for the second auger screw 13b2, reduces toner density variation in the toner image formed on the photoconductor 12.

A toner density detector, which, in the present illustrative embodiment, is a magnetic sensor 13h, is provided at the upstream portion of the first conveyance route below the first auger screw 13b1 to detect the toner density of the developer G circulated within the developing unit 13. New toner T is supplied from the toner cartridge 50 to the developing unit 13 via the toner supply opening 13e provided near the second transit part 13f based on the toner density detected by the magnetic sensor 13h.

The toner supply opening 13e is provided above the upstream portion of the first conveyance route for the first auger screw 13b1 and apart from the developing range outside the developing roller 13a in the longitudinal direction.

Although being disposed within the first conveyance route in the above-described example, alternatively, the toner supply opening 13e may be provided above the upstream portion of the second conveyance route.

Figure 4:
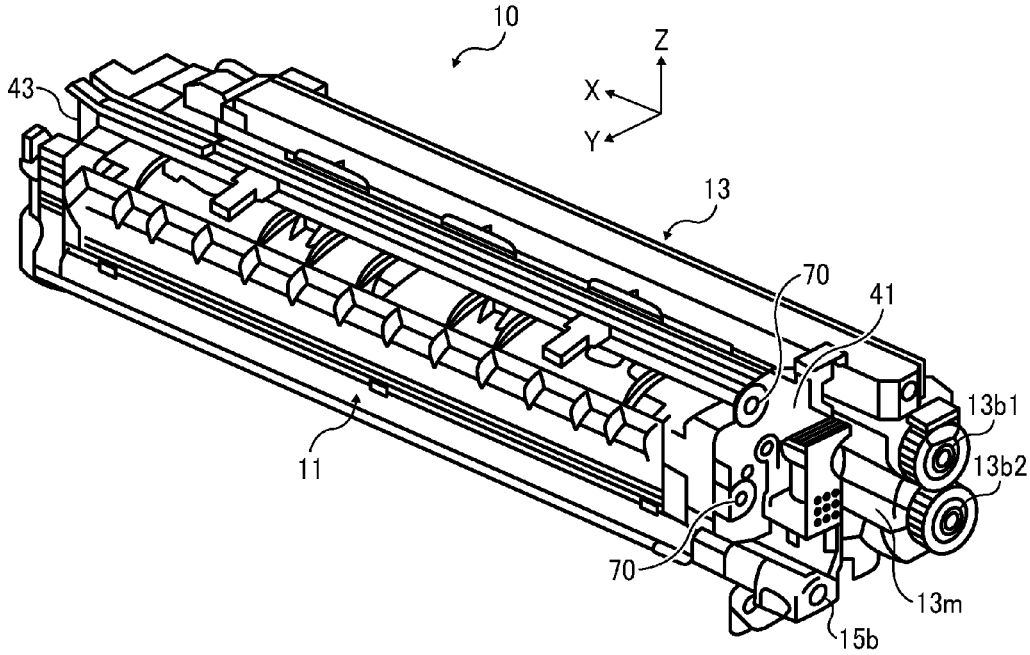
FIG. 4 is a perspective view of the process cartridge.
Figure 5:
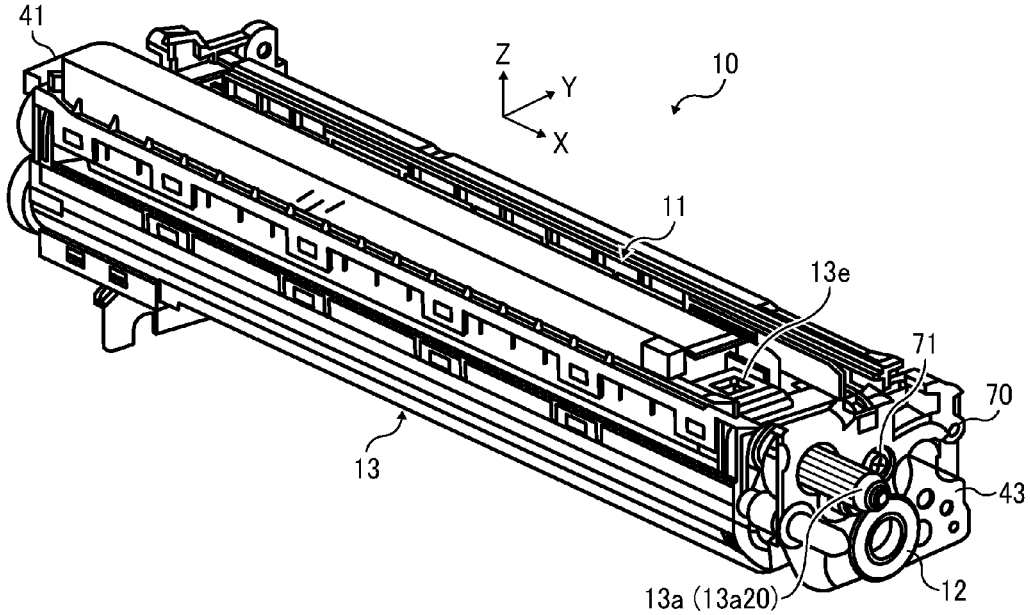
FIG. 5 is a perspective view of the process cartridge viewed from a different angle from that of FIG. 4.
Figure 6:
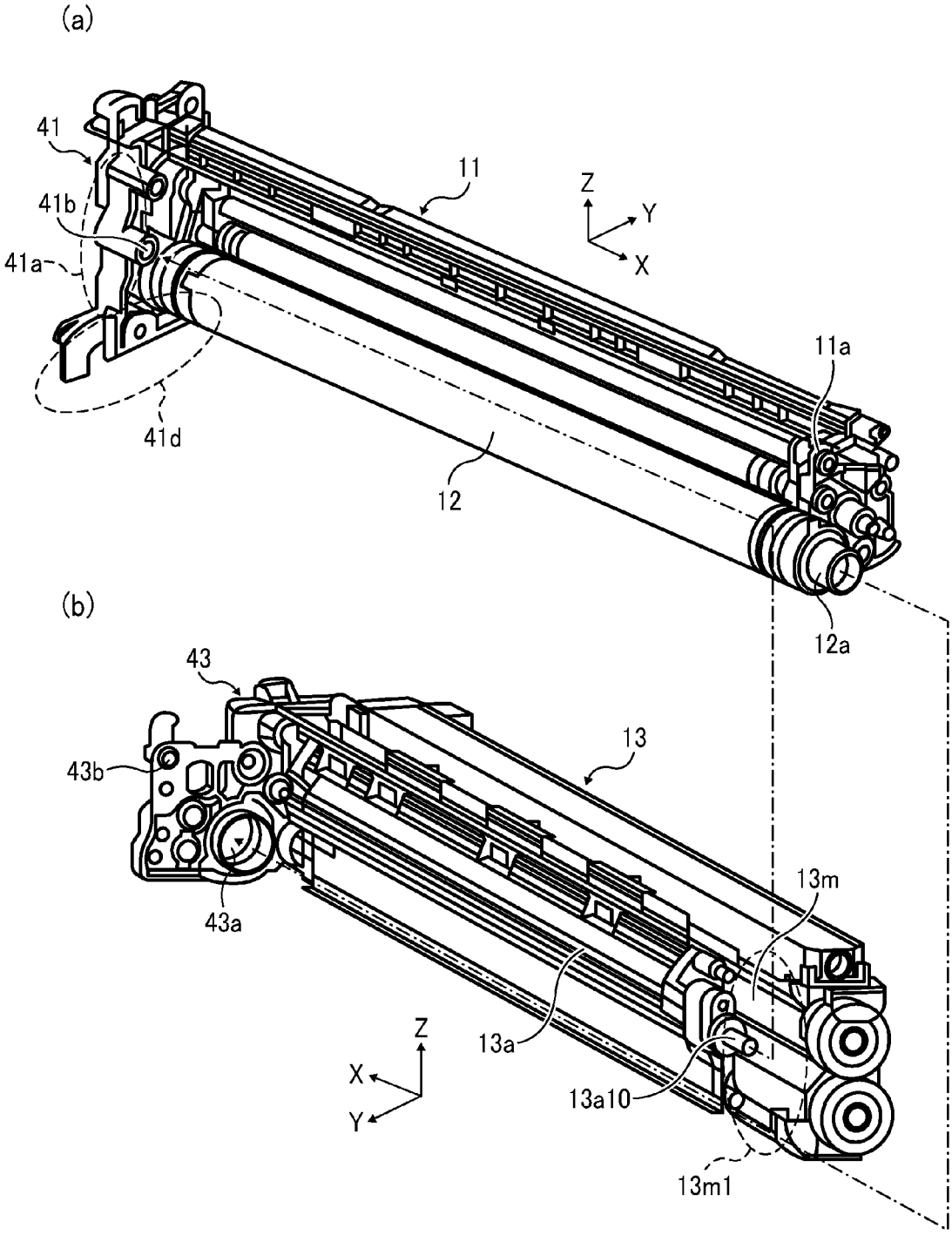
FIG. 6(*a*) is a perspective view of a photoconductor unit to which a front plate is fixed.
Figure 7A:
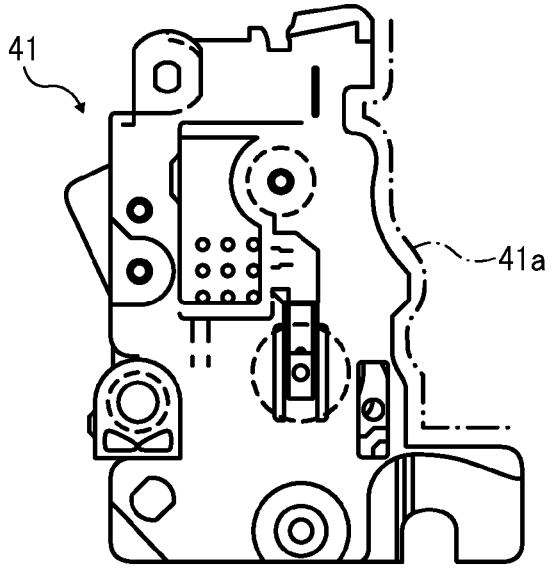
FIG. 7A is a front view of the front plate.
Figure 7B:
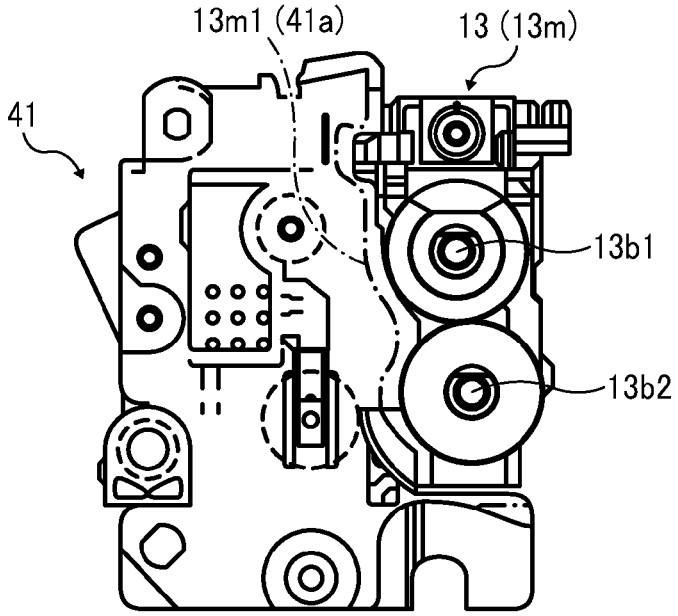
FIG. 7B is a front view illustrating a state in which the front plate and a protruding portion of the developing unit face each other.
Figure 8A:
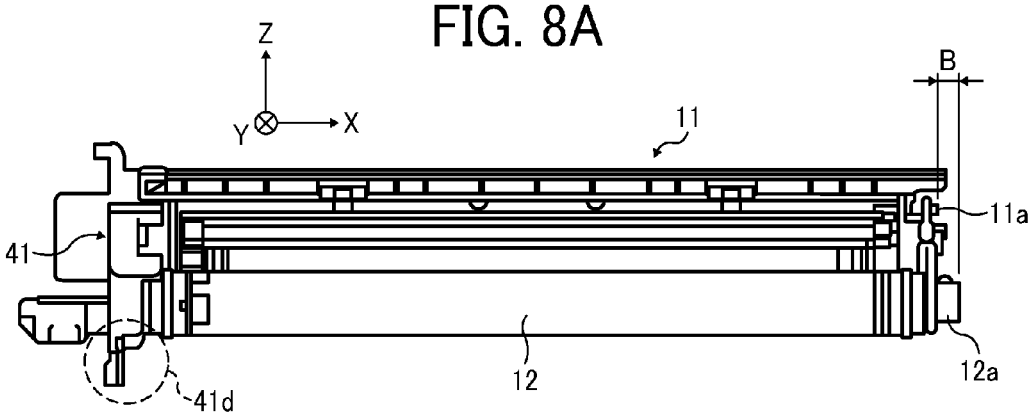
FIG. 8A is a side view of the photoconductor unit to which the front plate is fixed.
Figure 8B:
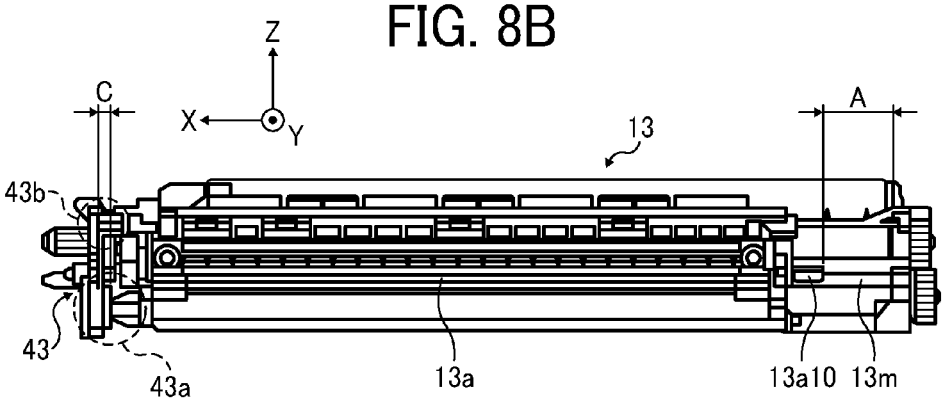
FIG. 8B is a side view of the developing unit to which the rear plate is fixed.
Figure 9A:
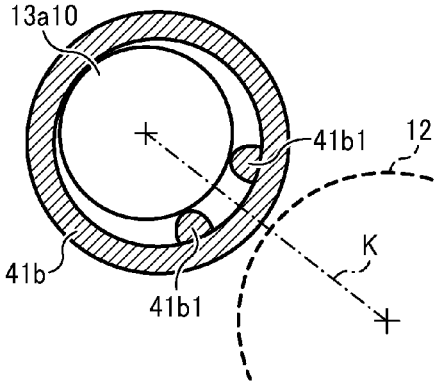
FIGS. 9A and 9B are schematic views respectively illustrating states of a magnet shaft of a developing roller inserted into a first positioning hole formed in the front plate.
Figure 9B:
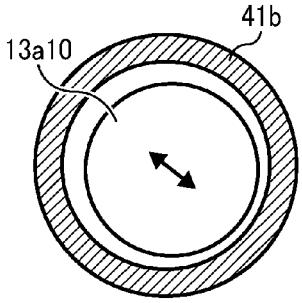

The configuration and operation of the process cartridge 10 according to the present illustrative embodiment are described below with reference to FIGS. 4 to 9. FIG. 4 is a perspective view of the process cartridge 10. FIG. 5 is a perspective view of the process cartridge 10 viewed from a different angle from that of FIG. 4. FIG. 6(a) is a perspective view of the photoconductor unit 11 to which the front plate 41 is fixed. FIG. 6(b) is a perspective view of the developing unit 13 to which a rear plate 43 is fixed. FIG. 7A is a front view of the front plate 41. FIG. 7B is a front view illustrating a state in which the front plate 41 and a protruding portion 13m of the developing unit 13 face each other. FIG. 8A is a side view of the photoconductor unit 11 to which the front plate 41 is fixed. FIG. 8B is a side view of the developing unit 13 to which the rear plate 43 is fixed. FIGS. 9A and 9B are schematic views respectively illustrating states of the magnet shaft 13a10 of the developing roller 13a inserted into a first positioning hole 41b formed in the front plate 41.

As described previously, each process cartridge 10 is detachably installable in the image forming apparatus 1. In a state in which a cover of the image forming apparatus 1, not shown, is opened, each process cartridge 10 is inserted into or detached from the image forming apparatus 1 in a direction indicated by arrow X in FIG. 1 and subsequent drawings (hereinafter referred to as X direction).

The process cartridge 10 includes the first sub-unit, which, in the present illustrative embodiment, is the photoconductor unit 11 that holds the photoconductor 12, the charging roller 14, the cleaning blade 15, and the lubricant applicator 16, and the second sub-unit, which, in the present illustrative embodiment, is the developing unit 13 that holds the developing roller 13a provided opposite the photoconductor 12 across the predetermined gap E. Thus, as illustrated in FIGS. 6(a) and 6(b), the process cartridge 10 is disassembled into the photoconductor unit 11 and the developing unit 13.

The process cartridge 10 further includes first and second positioning members, which, in the present illustrative embodiment, are the front and rear plates 41 and 43, respectively. The front plate 41 positions both the photoconductor 12 and the developing roller 13a at one end (or a front end) in the longitudinal direction (or the X direction). The rear plate 43 positions both the photoconductor 12 and the developing roller 13a at the opposite end (or the rear end) in the longitudinal direction.

Provision of the front and rear plates 41 and 43 can accurately and evenly keep the gap E between the photoconductor 12 and the developing roller 13a across the longitudinal direction.

Before the photoconductor unit 11 and the developing unit 13 are assembled together as the single integrated process cartridge 10, the front plate 41 is fixed to the front end of the photoconductor unit 11 in the longitudinal direction with two screws 70 while positioning the front end of the photoconductor unit 11. Specifically, one end of the drum shaft of the photoconductor 12 that protrudes beyond a lateral surface of the photoconductor unit 11 is inserted into a bearing fitted into the front plate 41 to position the front end of the photoconductor 12. In the above-described state, the screws 70 are fastened via the front plate 41 into female screw holes formed in the lateral surface of the photoconductor unit 11, respectively, so that the front plate 41 is fixed to the photoconductor unit 11.

Meanwhile, before the photoconductor unit 11 and the developing unit 13 are assembled together, the rear plate 43 is fixed to the rear end of the developing unit 13 in the longitudinal direction with a screw 71 while positioning the rear end of the developing roller 13a. Specifically, the sleeve shaft 13a20 of the developing roller 13a provided at the rear end of the developing roller 13a and protruding beyond a lateral surface of the developing unit 13 is inserted into a bearing fitted into the rear plate 43 to position the rear end of the developing roller 13a. In the above-described state, the screw 71 is fastened via the rear plate 43 into a female screw hole formed in the lateral surface of the developing unit 13, so that the rear plate 43 is fixed to the developing unit 13.

The developing unit 13 has the protruding portion 13*m* that protrudes beyond the front plate 41 toward the front end of the process cartridge 10 in the longitudinal direction. When the developing unit 13 is assembled into the process cartridge 10, the protruding portion 13*m* protrudes outward beyond the front plate 41 in the X direction.

When viewed from the cross-section perpendicular to the longitudinal direction, an opposing surface 13*m*1 of the protruding portion 13*m* that faces the front plate 41 is formed in conformity with a slide surface 41*a* formed as an outline of the front plate 41 as illustrated in FIG. 7B. In other words, the protruding portion 13*m* of the developing unit 13 is formed in conformity with the slide surface 41*a* of the front plate 41 across the longitudinal direction.

When the developing unit 13, to which the rear plate 43 is fixed, is attached to the photoconductor unit 11, to which the front plate 41 is fixed, to assemble as the process cartridge 10, the opposing surface 13*m*1 of the protruding portion 13*m* slides against the slide surface 41*a* of the front plate 41 to slidably move the developing unit 13 relative to the photoconductor unit 11 in the X direction. Accordingly, the photoconductor unit 11 and the developing unit 13 can be combined together as the process cartridge 10 while accurately keeping the gap E between the photoconductor 12 and the developing roller 13*a*. As a result, the photoconductor 12 and the developing roller 13*a* are prevented from striking each other upon assembly of the process cartridge 10, thereby reliably preventing damage to the surfaces of the photoconductor 12 and the developing roller 13*a*.

It is preferable that both the slide surface 41*a* of the front plate 41 and the opposing surface 13*m*1 of the protruding portion 13*m* be accurately formed in order to more securely keep the gap E between the photoconductor 12 and the developing roller 13*a*.

A description is now given of assembly of the process cartridge 10.

First, the developing unit 13, to which the rear plate 43 is fixed, is moved relative to the photoconductor unit 11, to which the front plate 41 is fixed, in the longitudinal direction by sliding the opposing surface 13*m*1 of the protruding portion 13*m* provided to the developing unit 13 against the slide surface 41*a* of the front plate 41. Then, the rear end of the photoconductor 12 is positioned by the rear plate 43 and the front end of the developing roller 13*a* is positioned by the front plate 41. Specifically, the developing unit 13 slides against the photoconductor unit 11 such that the magnet shaft 13*a*10 of the developing roller 13*a* is fitted with the first positioning hole 41*b* formed in the front plate 41 and a drum shaft 12*a* of the photoconductor 12 is fitted with a second positioning hole, which is an internal diameter of a bearing 43*a* provided to the rear plate 43.

After the photoconductor unit 11 and the developing unit 13 are combined together, the rear plate 43 is fixed to the rear end of the photoconductor unit 11 with a screw 70 as illustrated in FIG. 5. Thus, assembly of the process cartridge 10 is completed.

The above-described configuration of the process cartridge 10 can securely fix the positions of both the photoconductor unit 11 (or the photoconductor 12) and the developing unit 13 (or the developing roller 13*a*) in the longitudinal direction. Both ends of the photoconductor unit 11 in the longitudinal direction are fixed by the front and rear plates 41 and 43 with the screws 70 to determine the position of the photoconductor unit 11 in the longitudinal direction. Although being not fixed to the front plate 41, the developing unit 13 is fixed to the rear plate 43 with the screw 71, so that the position of the developing unit 13 in the longitudinal direction is also determined. Accordingly, the above-described configuration can prevent irregular development of the electrostatic latent image with the toner caused by an unfixed position of the photoconductor unit 11 or the developing unit 13 and toner scattering caused by vibration of the developing unit 13.

In addition, because the front plate 43 is fixed only to the photoconductor unit 11, even a difference in a size between the developing unit 13 and the photoconductor unit 11 in the longitudinal direction does not cause inclination or deformation of the front and rear plates 41 and 43. As a result, the gap E between the photoconductor 12 and the developing roller 13*a* can be evenly provided across the longitudinal direction, thereby preventing irregular resultant image with uneven toner density.

In the present illustrative embodiment, after the photoconductor unit 11, to which the front plate 41 is fixed, and the developing unit 13, to which the rear plate 43 is fixed, are assembled together, the rear plate 43 is fixed to the rear end of the photoconductor unit 11 with the screw 70 as described previously. Alternatively, the front plate 41 may be fixed to the front end of the developing unit 13 with a screw after the photoconductor unit 11, to which the front plate 41 is fixed, and the developing unit 13, to which the rear plate 43 is fixed, are assembled together. In such a case, the gap E between the photoconductor 12 and the developing roller 13*a* can be evenly provided across the longitudinal direction, thereby preventing irregular resultant image with uneven toner density.

In the present illustrative embodiment, assembly of the photoconductor unit 11 and the developing unit 13 is completed when the photoconductor unit 11 and the developing unit 13, which is moved relative to the photoconductor unit 11 in the longitudinal direction, contact each other. Accordingly, the front or rear plate 41 or 43 is appropriately fitted with the developing unit 13 or the photoconductor unit 11. Because the magnet shaft 13*a*10 of the developing roller 13*a* is fitted into the first positioning hole 41*b*, it is difficult to correct the position of the magnet shaft 13*a*10 after the magnet shaft 13*a*10 is fitted into the first positioning hole 41*b*. Therefore, the above-described configuration that can facilitate accurate assembly of the photoconductor unit 11 and the developing unit 13 as the single process cartridge 10 is usable.

A description is now given of the configuration of the process cartridge 10 in greater detail.

The first positioning hole 41*b*, into which the magnet shaft 13*a*10 of the developing roller 13*a* is inserted, is formed in the front plate 41. It is to be noted that the magnet shaft 13*a*10 is provided to the front end of the developing roller 13*a* and is not rotatable during operation of the process cartridge 10.

The second positioning hole, that is, the bearing 43*a* fitted into the rear plate 43 to rotatably support the photoconductor 12, is formed in the rear plate 43. The drum shaft 12*a* of the photoconductor 12 is fitted into the bearing 43*a*. In addition, a contact portion 43*b* that contacts a contacted portion 11*a* formed at the rear end of the photoconductor unit 11 is formed in the rear plate 43 to determine the position of the photoconductor unit 11 relative to the developing unit 13 in the longitudinal direction.

The above-described configuration allows easy assembly of the photoconductor unit 11, to which the front plate 41 is fixed, and the developing unit 13, to which the rear plate 43 is fixed, as the single process cartridge 10. Thus, the relative positions of the photoconductor unit 11 (or the photoconductor 12) and the developing unit 13 (or the developing roller 13*a*) in the longitudinal direction are determined simply by contacting the contact portion 43*b* of the rear plate 43 with the contacted portion 11*a* of the photoconductor unit 11 without a dedicated jig, thereby facilitating maintenance of the process cartridge 10.

Referring to FIGS. 8A and 8B, a relation of A>B+C is satisfied in the present illustrative embodiment, where A is a distance between a leading end of the magnet shaft 13*a*10 of the developing roller 13*a* and an end of the protruding portion 13*m*, both on the front end-side of the developing unit 13 in the longitudinal direction, B is a distance between an end of the contacted portion 11*a* and a leading end of the drum shaft 12*a* of the photoconductor 12, both on the rear end-side of the photoconductor unit 11 in the longitudinal direction, and C is a distance between an end of the contact portion 43*b* and an end of the second positioning hole, that is, the bearing 43*a*, both on the front end-side of the rear plate 43 in the longitudinal direction.

The above-described relation allows assembly of the photoconductor unit 11, to which the front plate 41 is fixed, and the developing unit 13, to which the rear plate 43 is fixed, by sliding the protruding portion 13*m* against the slide surface 41*a* of the front plate 41. In other words, the rear end of the photoconductor 12 of the photoconductor unit 11 can be positioned relative to the rear plate 43 and the front end of the developing roller 13*a* of the developing unit 13 can be positioned relative to the front plate 41 by sliding the protruding portion 13*m* against the slide surface 41*a* of the front plate 41, while accurately keeping the gap E between the developing roller 13*a* and the photoconductor 12.

As illustrated in FIG. 9A, ribs 41*b*1 are provided to the first positioning hole 41*b* formed in the front plate 41 so that the magnet shaft 13*a*10 is fitted into the first positioning hole 41*b* while being pressed against one part of an internal diameter of the first positioning hole 41*b* in a circumferential direction. The ribs 41*b*1 protrude inward from two positions on the internal surface of the first positioning hole 41*b*, respectively, and a leading end of each rib 41*b*1 is curved.

Provision of the ribs 41*b*1 to the first positioning hole 41*b* can accurately position the magnet shaft 13*a*10 of the developing roller 13*a*, which is fitted into the first positioning hole 41*b*, at reduced costs, for the reasons described below. In a case in which the size of the first positioning hole 41*b* is not accurately formed, a gap is generated between the magnet shaft 13*a*10 and the first positioning hole 41*b* as illustrated in FIG. 9B, thereby preventing accurate fitting of the magnet shaft 13*a*10 into the first positioning hole 41*b* and thus preventing accurate formation of the gap E between the photoconductor 12 and the developing roller 13*a*. Accurate formation of the size of the first positioning hole 41*b* is conceivable, however, it also increases production costs. By contrast, in the present illustrative embodiment, the ribs 41*b*1 are provided to the first positioning hole 41*b* as illustrated in FIG. 9A so that the magnet shaft 13*a*10 of the developing roller 13*a* fitted into the first positioning hole 41*b* can be accurately positioned without accurate formation of the size of the first positioning hole 41*b*. As describe previously, the magnet shaft 13*a*10 of the developing roller 13*a* is not rotatable and thus can be fitted into the first positioning hole 41*b*.

In addition, when viewed from the cross-section perpendicular to the longitudinal direction, each rib 41*b*1 is formed to press the developing roller 13*a* away from the photoconductor 12 in a direction along a virtual line K that connects the center of rotation of the photoconductor 12 and the center of rotation of the developing roller 13*a*.

As a result, a variation in the gap E caused by interference of the protruding portion 13*m* and the slide surface 41*a* with each other can be securely prevented upon assembly of the photoconductor unit 11, to which the front plate 41 is fixed, and the developing unit 13, to which the rear plate 43 is fixed, by sliding the protruding portion 13*m* against the slide surface 41*a* of the front plate 41. Accordingly, the gap E on the front plate 41 side is securely determined by positioning the magnet shaft 13*a*10, which is fitted into the first positioning hole 41*b* of the front plate 41 fixed to the photoconductor unit 11.

Further, a protrusion 41*d* protruding downward in a direction perpendicular to the longitudinal direction is formed in the front plate 41.

Provision of the protrusion 41*d* at the bottom of the front plate 41 positions the photoconductor 12 apart from the floor or the like even when the process cartridge 10 or the photoconductor unit 11 is detached from the image forming apparatus 1 and is placed on the floor with the photoconductor 12 facing down, thereby preventing damage to the surface of the photoconductor 12.

In the present illustrative embodiment, the process cartridge 10 is installed in the image forming apparatus 1 in the longitudinal direction with the front plate 41 facing the front and the rear plate 43 facing the rear in a direction of installation of the process cartridge 10 in the image forming apparatus 1, respectively. Therefore, provision of the protrusion 41*d* to the front plate 41 does not interfere with the components within the image forming apparatus 1 upon installation of the process cartridge 10 in the image forming apparatus 1, thereby achieving smooth installation and detachment of the process cartridge 10 in and from the image forming apparatus 1.

In the present illustrative embodiment, before assembly of the photoconductor unit 11 and the developing unit 13 as the process cartridge 10, the front plate 41 is fixed to the front end of the photoconductor unit 11 while positioning the front end of the photoconductor 12, and the rear plate 43 is fixed to the rear end of the developing unit 13 while positioning the rear end of the developing roller 13*a*. The protruding portion 13*m* protruding outward beyond the front plate 41 toward the front end of the process cartridge 10 is provided to the developing unit 13 in conformity with the outline of the front plate 41. As a result, the gap E between the photoconductor 12 and the developing roller 13*a* can be accurately and evenly maintained across the longitudinal direction without damage to the surfaces of the photoconductor 12 and the developing roller 13*a* upon assembly of the process cartridge 10.

Although the photoconductor unit 11 is constructed of the photoconductor 12, the charging roller 14, the cleaning blade 15, and the lubricant applicator 16 in the foregoing illustrative embodiment, the configuration of the photoconductor unit 11 is not limited thereto as long as the photoconductor 12 is held by the photoconductor unit 11. For example, alternatively, the photoconductor unit 11 may be constructed of the photoconductor 12, the charger, and the cleaning blade.

Although the developing unit 13 is constructed only of the developing part in the foregoing illustrative embodiment, the configuration of the developing unit 13 is not limited thereto as long as the developing roller 13*a* is held by the developing unit 13. For example, alternatively, the developing unit 13 may be constructed of the charger and the developing part including the developing roller 13*a*.

In such a case, the same effects as those achieved by the foregoing illustrative embodiment can be achieved.

The foregoing illustrative embodiment is applicable not only to the tandem-type image forming apparatus 1 using the intermediate transfer belt 17 but also to a tandem-type image forming apparatus using a transfer conveyance belt in which toner images respectively formed on multiple photoconductors arranged side by side opposite the transfer conveyance belt are sequentially transferred one atop the other on a recording medium conveyed by the transfer conveyance belt, a monochrome image forming apparatus, or the like. In such a case, the same effects as those achieved by the foregoing illustrative embodiment can be achieved.

Although the front plate 41 is used as the first positioning member provided to the front and the rear plate 43 is used as the second positioning member provided to the rear in the direction of installation of the process cartridge 10 in the image forming apparatus 1 according to the foregoing illustrative embodiment, alternatively, the positions of the first and second positioning members may be reversed. In such a case, the same effects as those achieved by the foregoing illustrative embodiment can be achieved.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A process cartridge detachably installable in an image forming apparatus, comprising:

a first sub-unit to hold an image carrier;

a second sub-unit to hold a developer bearing member disposed opposite the image carrier across a predetermined gap;

a first positioning member to position first ends of the image carrier and the developer bearing member in a longitudinal direction, respectively, the first positioning member being fixed to a first end of the first sub-unit in the longitudinal direction while positioning the first end of the image carrier before assembly of the first and second sub-units; and a second positioning member to position second ends of the image carrier and the developer bearing member opposite the first ends in the longitudinal direction, respectively, the second positioning member being fixed to a second end of the second sub-unit in the longitudinal direction while positioning the second end of the developer bearing member before the assembly of the first and second sub-units, the second sub-unit having a protruding portion protruding outward to a first end of the second sub-unit opposite the second end beyond the first positioning member in the longitudinal direction, an opposing surface of the protruding portion provided to face the first positioning member dimensioned to conform to a cross-section of the first positioning member perpendicular to the longitudinal direction.

2. The process cartridge according to claim 1, wherein, after the second sub-unit, to which the second positioning member is fixed, is moved relative to the first sub-unit, to which the first positioning member is fixed, in the longitudinal direction by moving the protruding portion along the first positioning member to position the second end of the image carrier by the second positioning member and the first end of the developer bearing member by the first positioning member, the second positioning member is fixed to a second end of the first sub-unit opposite the first end in the longitudinal direction, or the first positioning member is fixed to the first end of the second sub-unit.

3. The process cartridge according to claim 1, further comprising:

a first positioning hole provided to the first positioning member, to which a shaft formed at the first end of the developer bearing member is fitted;

a second positioning hole provided to the second positioning member, to which the second end of the image carrier is fitted; and a contact portion provided to the second positioning member to determine a position of the first sub-unit relative to the second sub-unit in the longitudinal direction by contacting a contacted portion provided to the second end of the first sub-unit.

4. The process cartridge according to claim 3, wherein a relation of A>B+C is satisfied, where:

A is a distance between a leading end of the shaft of the developer bearing member and an end of the protruding portion, both on a first end-side of the second sub-unit in the longitudinal direction;

B is a distance between an end of the contacted portion and a leading end of the image carrier, both on a second end-side of the first sub-unit in the longitudinal direction; and C is a distance between an end of the contact portion and an end of the second positioning hole, both on a first end-side of the second positioning member in the longitudinal direction.

5. The process cartridge according to claim 3, wherein the second positioning hole of the second positioning member rotatably holds the image carrier.

6. The process cartridge according to claim 3, wherein:

the shaft of the developer bearing member is not rotatable during operation of the process cartridge; and the first positioning hole has a rib formed on an internal surface of the first positioning hole to press the shaft of the developer bearing member fitted into the first positioning hole against a part of an internal surface of the first positioning hole opposite the rib.

7. The process cartridge according to claim 6, wherein the rib is positioned to press the developer bearing member in a direction away from the image carrier along a virtual line connecting a center of a rotation of the image carrier and a center of rotation of the developer bearing member when viewed from the cross-section perpendicular to the longitudinal direction.

8. The process cartridge according to claim 1, wherein:

the process cartridge is installed in the image forming apparatus in the longitudinal direction with the first positioning member at the front and the second positioning member at the rear in a direction of installation of the process cartridge in the image forming apparatus; and the first positioning member further comprises a protrusion protruding in a direction of exposure of the image carrier outside the process cartridge and perpendicular to the longitudinal direction.

9. An image forming apparatus comprising at least one process cartridge detachably installable in the image forming apparatus, the process cartridge comprising:

a first sub-unit to hold an image carrier;

a second sub-unit to hold a developer bearing member disposed opposite the image carrier across a predetermined gap;

a first positioning member to position first ends of the image carrier and the developer bearing member in a longitudinal direction, respectively, the first positioning member being fixed to a first end of the first sub-unit in the longitudinal direction while positioning the first end of the image carrier before assembly of the first and second sub-units; and a second positioning member to position second ends of the image carrier and the developer bearing member opposite the first ends in the longitudinal direction, respectively, the second positioning member being fixed to a second end of the second sub-unit in the longitudinal direction while positioning the second end of the developer bearing member before the assembly of the first and second sub-units, the second sub-unit having a protruding portion protruding outward to a first end of the second sub-unit opposite the second end beyond the first positioning member in the longitudinal direction, an opposing surface of the protruding portion provided to face the first positioning member dimensioned to conform to a cross-section of the first positioning member perpendicular to the longitudinal direction.

* * * * *